United States Patent [19]

Scholley

[11] Patent Number: 4,932,403

[45] Date of Patent: Jun. 12, 1990

[54] FLEXIBLE CONTAINER FOR COMPRESSED GASES

[76] Inventor: Frank G. Scholley, 922 E. Sparrow Rd., Virginia Beach, Va. 23464

[21] Appl. No.: 337,901

[22] Filed: Apr. 14, 1989

[51] Int. Cl.[5] ..... A62B 7/00

[52] U.S. Cl. ..... 128/205.22

[58] Field of Search ..... 128/205.22, 200.24, 128/204.18

[56] References Cited

FOREIGN PATENT DOCUMENTS 971689 3/1959 Fed. Rep. of Germany ..... 128/205.22

*Primary Examiner*—Eugene H. Eickholt

[57] ABSTRACT

A container made in the form of a continuous length of hose incorporating expanded diameter storage sections and flexible connecting sections into its length. Storage sections provided primary storage space for the compressed gases. Connecting sections are extremely flexible and enable the hose to be configured into a compact and contouring shape.

4 Claims, 1 Drawing Sheet

FIG. 1
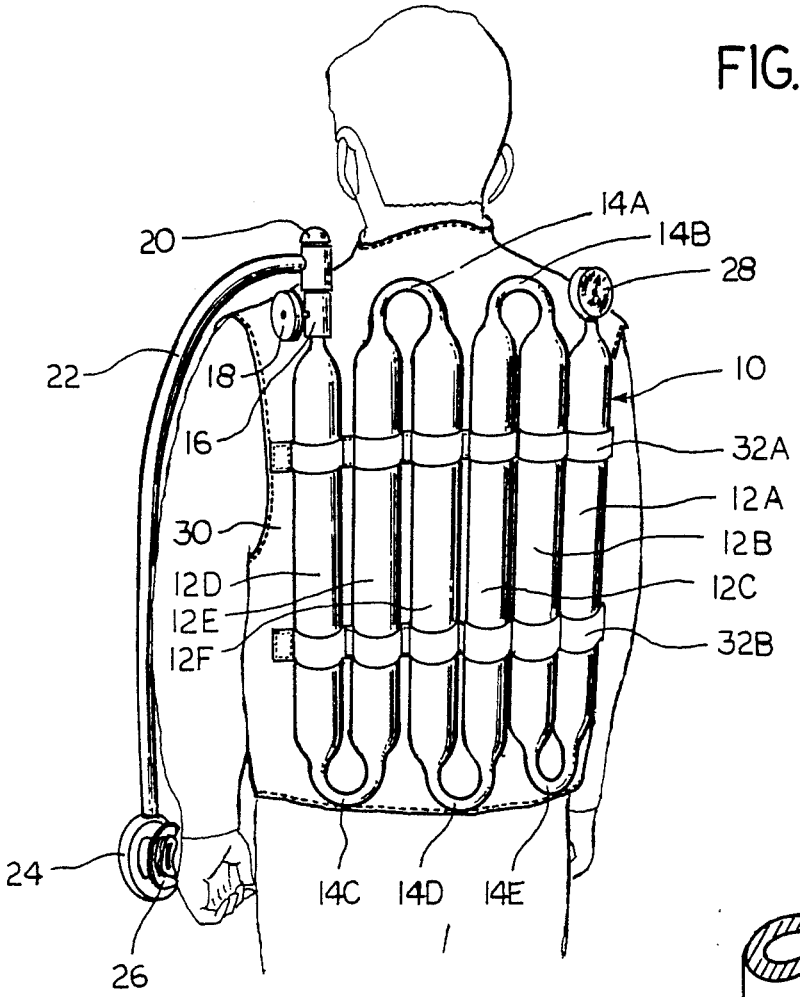
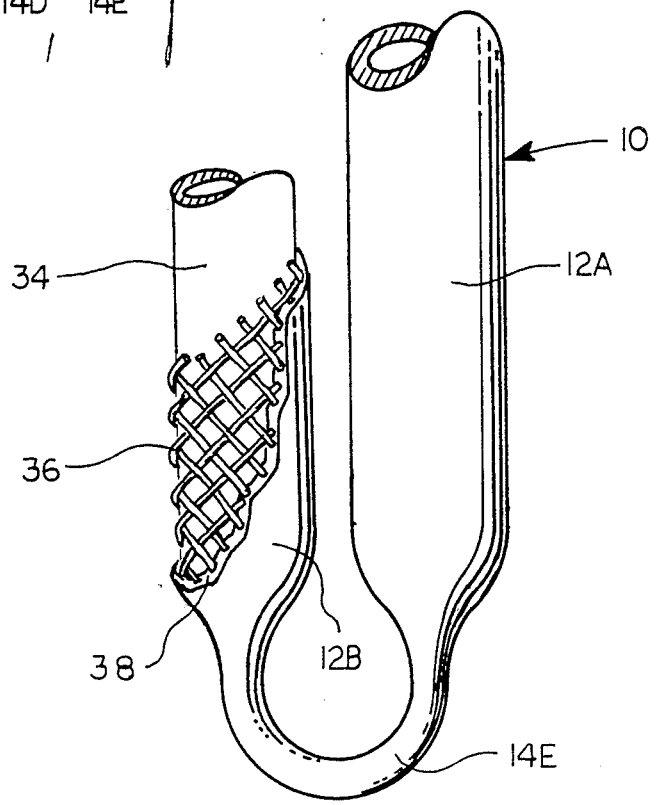
FIG. 2

FLEXIBLE CONTAINER FOR COMPRESSED GASES

BACKGROUND

1. Field of Invention

This invention relates to containers for compressed gases, specifically to such containers which are carried on a person.

2. Description of Prior Art

Divers, firefighters, miners, and the like must perform numerous tasks which require that carry a portable supply of compressed gases. These compressed gases are usually for breathing in an unbreathable environment. However, other gases such as carbon dioxide, used for extinguishing fires, are also carried.

Conventional containers for this purpose are normally of a cylindrical shape with domed ends. Construction is usually of steel or aluminum. Unfortunately, these containers are cumbersome to wear due to their bulky shape, their rigid structure, and their relatively heavy weight. As a result, wearers are unable to move in confined spaces, are uncomfortable, and are subject to increased levels of fatigue.

Inventors have developed several ways to partially solve these problems. U.S. Pat. No. 3,338,238 to Warncke (1967) discloses a complex multicell container which can be made in a relatively flat oval-shaped cross section. However, these containers are difficult to manufacture and do not conform to the shape of the wearer. U.S. Pat. No. 3,491,752 to Cowley (1970) shows a slightly flexible pressure vessel made in the form of a spirally coiled tube. This vessel is compact and lightweight, but ineffective if more than several minutes of breathing gases are required.

The storage capacity of Cowley's pressure vessel could be increased by using either larger diameter tube or thicker walled tube. However, these obvious improvements are impractical since tubing of increased dimensions would not easily coil into a compact shape.

While some minor improvements in portable containers for compressed gases have been made, all such containers heretofore known suffer from a number of disadvantages:

(a) If the containers hold more than a few minutes worth of breathing gases, they are large in size and protrude a great distance from the wearer's body. This makes movement through the water or small spaces difficult.

(b) Containers designed to hold high pressures are not highly flexible. Nonflexible structures do not contour to the wearer's body and are uncomfortable to wear.

(c) Containers in present use are relatively heavy.

(d) The manufacture of existing containers is complex and costly.

OBJECTS AND ADVANTAGES

Accordingly, several objects and advantages of my invention are:

(a) to provide a portable container for compressed gases which protrudes only a small distance from the wearer's body;

(b) to provide a container which is highly flexible and contours to the wearer's body;

(c) to provide a container which is lightweight;

(d) to provide a container which is simple to manufacture and is not prohibitively expensive.

Further objects and advantages of my invention will become apparent from a consideration of the ensuing description and drawings.

DRAWING FIGURES

The means by which the objects of the invention are obtained are described more fully with reference to the accompanying drawings in which:

FIG. 1 is a perspective view of a typical embodiment of the container rigged for breathing gases.

FIG. 2 is an enlarged perspective view, in partial cut-away, of a typical cross section of the container.

DESCRIPTION-FIGS. 1 and 2

A typical embodiment of the present invention is illustrated in FIG. 1. The container is made in the form of a one piece continuous length of hose 10 with expanded diameter approximately parallel storage sections 12A-F and with more fexible narrow diameter connecting sections 14A-E maintained in a bent attitude. The storage sections 12A-F serve as the primary storage spaces for the compressed gases. A typical dimension of these storage sections 12A-F is 5 centimeters in outside diameter. The connecting sections 14A-E are extremely flexible and enable the hose 10 to be configured into a serpentine shape. A typical dimension of these connecting sections 14A-E is 1.5 centimeters in outside diameter. Attached to one end of the hose 10 is a valve 16 operated by a handle 18. Attached to the valve 16 is a usual pressure regulator 20 which reduces the pressure of gases to a low pressure tube 22. The tube 22 provides low pressure gases to a usual demand flow regulator 24 fitted with a mouthpiece 26. Attached to the other end of the hose 10 is a usual pressure indicator 28. The hose 10 is fastened to a vest 30 having arm openings with an upper strap 32A and a lower strap 32B.

In FIG. 2 a typical cross section, in partial cut-away, of the hose 10 is illustrated. A continuous length of flexible liner 34 is of a noncontaminating material such as flexible grade nylon-11. Other materials such as polyethylene, silicon, vinyl, rubber, or tetrafluoroethylene can also be used as the liner 34. To give the container high pressure capabilities, the liner 34 is overbraided with high strength braid 36. KEVLAR-brand braid; KEVLAR is a trademark of E.I. DuPont de Nemours & Co., Wilmington, DE, is one type of braid that works well. To prevent abrasion and wear, the braid 36 is preferably coated and impregnated with a flexible protective covering 38 of polyurethane.

By way of example, a container with six storage sections of 4 centimeters inside diameter and 60 centimeters length gives a gas storage capacity of approximately 2700 liters at 600 kilograms per square centimeter of pressure. This provides about 2 hours worth of breathing gases for a wearer working under normal atmospheric conditions. Such a container weighs approximately 4 kilograms.

SUMMARY, RAMIFICATIONS, AND SCOPE

Thus, the reader will see that the container of the invention provides a minimally protruding, highly flexible, lightweight, and easy to manufacture vessel for portable storage of compressed gases. It will enable its wearer to work in smaller spaces, with greater comfort and less fatigue.

While my above description contains many specific details, these should not be construed as limiting the scope of the invention, but rather as an exemplification of one preferred embodiment thereof. Many other variations are possible. For example, the container can be serpentined into other shapes, can be fitted to other garments, can be closed off with other fittings, and can be made of other materials. Accordingly, the scope of the invention should be determined not by the embodiment illustrated, but by the appended claims and their legal equivalents.

I claim:

1. A flexible container for compressed gases to be worn on an individual's back comprising:

a one piece continuous length of hose constructed of flexible material including a plurality of elongated expanded-diameter storage sections and a plurality of elongated, narrow-diameter sections, said expanded-diameter and narrow-diameter sections being alternately arranged along the length of said hose, said expanded-diameter storage sections having cross-sections that are substantially greater in diameter than the diameters in cross-section of said narrow-diameter sections, said expanded-diameter storage sections and said narrow-diameter storage sections being constructed as one continuous piece of flexible material to form said length of hose with an interior liner constructed of a continuous flexible material covered along the length thereof by one or more layers of braided fibers coated with, and impregnated in, a continuous flexible protective covering, said elongated, narrow-diameter sections being substantially more flexible than said elongated expanded-diameter storage sections because of their reduced diameters; and a carrier on which individual ones of said elongated expanded-diameter storage sections are mounted approximately parallel to one another with said flexible narrow-diameter sections being maintained in bent attitudes.

2. A flexible container as in claim 1 wherein the carrier is a vest having arm openings therein to be worn on an individual's torso.

3. A flexible container as in claim 1 wherein said hose has a valve and pressure regulator positioned at one end thereof communicating with a mouthpiece to supply compressed gases to a mouth of an individual wearing the flexible container.

4. A flexible container as in claim 1 wherein a pressure gauge is mounted at an opposite end of the hose for communicating with an interior of the hose to provide a measurement of relative pressure of said compressed gases.

* * * * *